United States Patent [19]

Cohen

[11] Patent Number: 4,759,153

[45] Date of Patent: Jul. 26, 1988

[54] METHOD AND APPARATUS FOR SHARPENING A SERRATED CUTTING EDGE

[76] Inventor: Morton Cohen, 60 Otis St., West Babylon, N.Y. 11704

[21] Appl. No.: 885,172

[22] Filed: Jul. 14, 1986

[51] Int. Cl.[4] ..... B24B 15/08

[52] U.S. Cl. ..... 51/211 R; 51/181 R; 51/285; 76/89.1; 76/82

[58] Field of Search ..... 76/89.1, 82, 82.2, 36; 51/211 R, 211 H, 214, 181 R, 285

[56] References Cited

U.S. PATENT DOCUMENTS

| | | | |
|---|---|---|---|
| 1,719,351 | 7/1929 | Wood | 76/36 |
| 2,471,699 | 5/1949 | Pavesi et al. | 76/89.1 |
| 2,705,430 | 4/1955 | Strandberg | 76/36 |
| 3,518,900 | 7/1970 | Ehlen et al. | 76/36 |
| 3,894,362 | 7/1975 | Graves | 51/211 R |
| 4,228,703 | 10/1980 | Moss | 76/82.2 |
| 4,555,965 | 12/1985 | Deaton | 76/89.1 |

FOREIGN PATENT DOCUMENTS

| | | | |
|---|---|---|---|
| 0229158 | 5/1959 | Australia | 51/211 R |

*Primary Examiner*—Frederick R. Schmidt
*Assistant Examiner*—Robert A. Rose
*Attorney, Agent, or Firm*—Roberts, Spiecens & Cohen

[57] ABSTRACT

A method is provided for sharpening a serrated cutting edge having spaced points separated by indentations. The method involves loosely supporting a plurality of rods of abrasive material and then applying the cutting edge tranversely across the rods so that the rods are forced into positions whereat they are spaced in correspondence with the indentations. The rods are locked in the resultant positions whereafter the cutting edge is wiped along the rods with the rods being positioned in the indentations. The apparatus for practicing the aforesaid methods involves a plurality of elongated rods supported on a resilient pad and clamped into position by the use of clamping devices which are adjustable to release the rods for positioning and to hold the rods in position once they are moved into the appropriate positions.

18 Claims, 2 Drawing Sheets

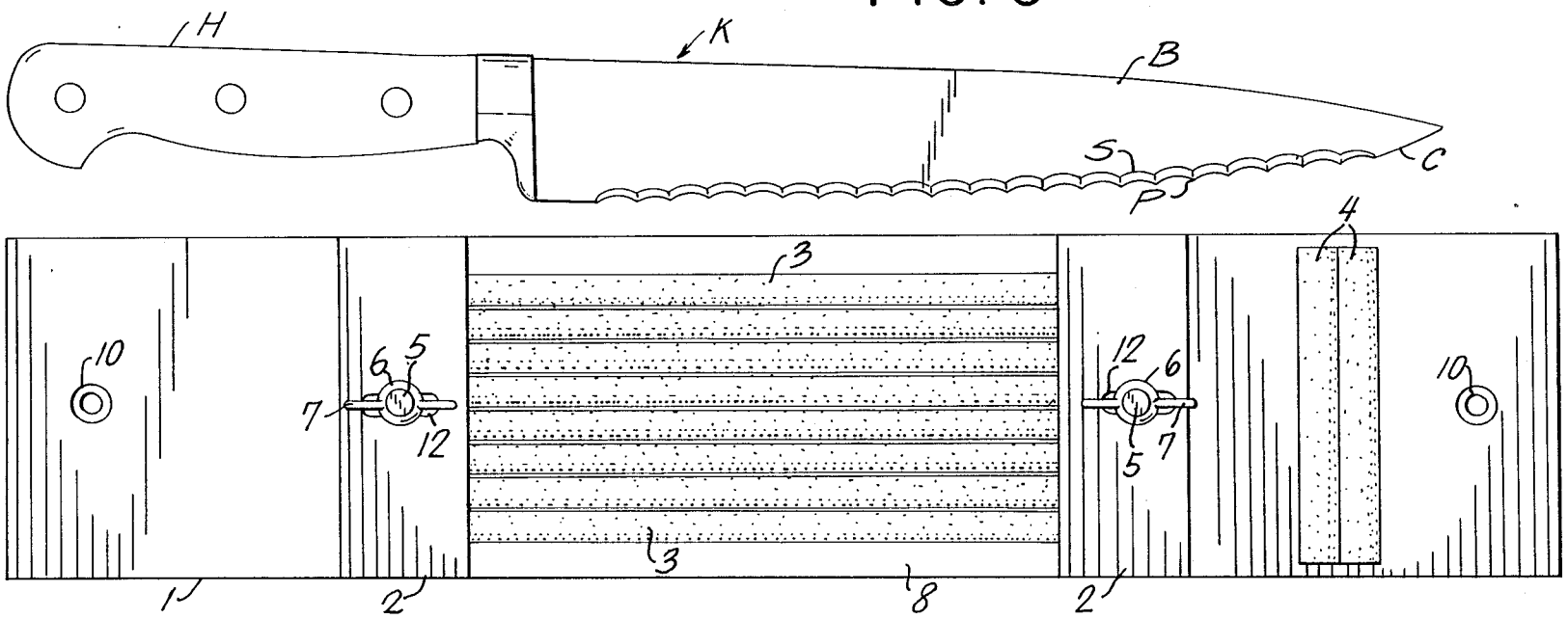
FIG. 5
FIG. 1
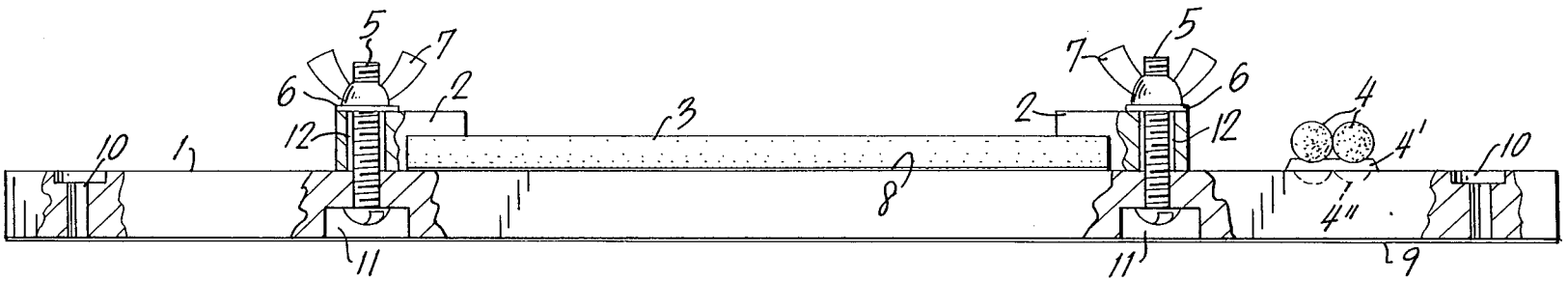
FIG. 2

METHOD AND APPARATUS FOR SHARPENING A SERRATED CUTTING EDGE

FIELD OF INVENTION

This invention relates to methods and devices for sharpening cutting edges and more particularly to devices and methods for sharpening a serrated cutting edge of the type having a plurality of indentations forming a series of points along the cutting edge.

BACKGROUND

In researching my invention preparatory to determining the novelty thereof, I have become aware of a number of U.S. patents including U.S. Pat. Nos. 648,090; 1,951,554; 2,451,203; 2,770,153; 3,322,002; 4,532,736; and 4,555,965.

None of the above patents relates particularly to the apparatus or method of my invention, but some of these patents relate to serrated cutting edges and other of these patents have certain features which vaguely relate to the structure of my invention as set forth in detail hereinbelow.

W. Thompson in U.S. Pat. No. 648,090 reveals a sharpening device consisting of a cylindrical block provided with a longitudinally serrated surface. F. Rodoni shows in U.S. Pat. No. 2,770,153 a cutting element which has a series of file-like surfaces which can be employed to form a series of serrations. W. C. Martin in U.S. Pat. No. 1,951,554 shows a grooved surface which is somewhat like a feature employed in the present invention. However, this grooved surface is provided for an entirely different reason in the Martin structure. Notably, it is employed for constituting a guide for a trailing device intended to guide the movement of a cutting edge along a honing stone.

In U.S. Pat. No. 4,555,965, M. Deaton shows a rather sophisticated scissors corrugating device which includes an elongated corrugating file having upper and lower guides attached thereto with a frame being provided for supporting the guides. These guides move in various slots to provide strokes of the file across the bevelled edge of a clamped blade of a scissors and thus the file moves in such a manner as to score corrugations evenly with repeatability along the bevelled edge. As will become apparent hereinafter, none of the aforementioned patents achieve the objectives of the instant invention either as regards the apparatus or the method.

SUMMARY OF INVENTION

It is an object of the invention to provide improved means for sharpening a cutting edge having a plurality of indentations therein defining a series of points along the cutting edge.

It is another object of the invention to provide an improved sharpening device susceptible of adjustment for different spacings of serrations arranged along cutting edges of cutting devices.

It is still another object of the invention to provide improved methods relating to the adjustment of a sharpening device to account for the different spacings of serrations along a cutting edge.

Yet another object of the invention is to provide an improved sharpening device capable of accommodating sharpening rods of various lengths.

Still another object of the invention is to provide an improved sharpening device which provides for sharpening the indented portions of a serrated cutting edge while also providing for the sharpening of the points which are located between the indentations.

In achieving the above and other objects of the invention, there is provided generally a method of sharpening a serrated cutting edge having spaced points separated by indentations, said method comprising loosely supporting a plurality of rods of abrasive material, applying the cutting edge transversely across the rods with the points at least in part between the rods so that the rods move into positions whereat they are spaced in correspondence with the indentations, locking the rods in the thusly determined positions, and wiping the edge along the thusly positioned rods so that the rods may be positioned in the indentations.

According to a feature of the invention, the locking of the rods is effected by clamping the same against a resilient pad. According to a further feature of the invention, two further abrasive rods are supported in parallel relation and the points of the cutting edge are tracked between these two further rods in order to sharpen the points.

As to the apparatus of the invention, this may be generally regarded as an apparatus for sharpening a cutting edge having a plurality of indentations therein, said apparatus comprising a plurality of loose, elongated sharpening devices responsive to the application of the cutting edge to align with the aforesaid indentations. Further provided in this apparatus is a locking arrangement for locking the thusly aligned sharpening devices in position so that the cutting edge can be wiped along the same to sharpen the cutting edge within the indentations.

As has been implied hereinabove, the apparatus of the invention includes a resilient device to support the sharpening devices, the locking arrangement urging the sharpening devices in part into the resilient arrangement. According to yet another feature of the invention, the apparatus provides for the situation wherein the cutting edge includes points between the indentations as noted hereinabove. In relation thereto, the apparatus further comprises additional sharpening devices defining a receptacle therebetween for receiving the points for sharpening the same.

Yet another object of the invention is achieved by the provision of support means for supporting the resilient arrangement with the sharpening devices thereon. This support means further supports the locking arrangement for clamping the sharpening devices against the resilient arrangement.

According to a preferred embodiment of the invention, the aforesaid sharpening devices are parallel rods of abrasive material. According to a further feature of the preferred embodiment, the locking arrangement is constituted by clamping members positioned to engage the ends of the aforesaid rods. At least one of these clamping members is adjustable to enable the clamping of rods of different lengths. As will be shown in detail hereinbelow, the clamping members include flanges overlying the end portions of the rods and a tightening arrangement such as a threaded rod and a cooperating nut is employed for pressing the flanges against the rods. It will also be noted hereinbelow that the clamping member which is adjustable, if indeed both of these members are not adjustable, is provided with an elongated slot to receive the associated threaded bolt.

The additional sharpening devices referred to hereinabove are parallel rods of abrasive material fastened to the above-mentioned support means. The additional rods are positioned in at least substantially orthogonal relationship to the first group of rods whose positions are adjustable. The rods are in the preferred embodiment of the invention of circular cross-section.

The invention may be regarded in a different sense as an apparatus for sharpening a serrated cutting edge having a plurality of indentations therein and comprising a plurality of rods of abrasive material in parallel relationship with adjusting means being provided to permit adjustment of the spacing of the rods to correspond to the positions of the indentations.

The above and other objects and features of the invention will be found in the following detailed description of a preferred embodiment thereof as illustrated in the accompanying drawing.

BRIEF DESCRIPTION OF DRAWING

In the drawing:

FIG. 1 is a top view of a sharpening device for sharpening serrated cutting edges in accordance with the invention;

FIG. 2 is a side view of the sharpening device of FIG. 1;

FIG. 5 illustrates a cutting instrument having a cutting edge whose serrations and points may be sharpened in accordance with the method of the invention and by the use of the apparatus illustrated in FIGS. 1–3.

DETAILED DESCRIPTION

Figure 3:
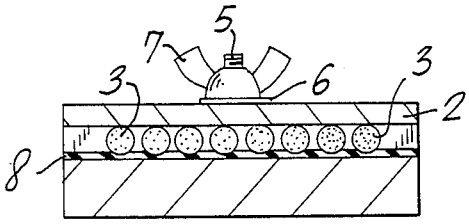
FIG. 3 is a cross-sectional view of the device illustrated in FIGS. 1 and 2.
Figure 4A:
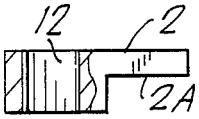
FIG. 4A is a side cross-sectional view of one of the clamping devices employed in the apparatus of FIGS. 1–3.
Figure 4B:
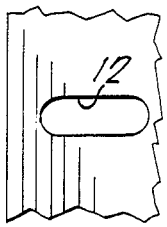
FIG. 4B is a fragmentary top view of the clamping device of FIG. 4A.

The apparatus illustrated in the drawing includes a base 1 which is of various possible shapes and which is of a generally rigid material such as wood, plastic, hard rubber or metal or the like. On the base 1 are mounted clamps 2 in spaced relationship. These clamps can also be made of various material such as wood, plastic, rubber, metal or the like. As illustrated in FIGS. 4A and 4B, each clamp 2 has a flange 2A and is provided with a central bore in the form of an elongated slot such as indicated at 12. The purpose of this slot is to enable an adjustment of one or both of the clamps 2 so as to be able to accommodate different lengths of sharpening members as will be explained in greater detail hereinbelow.

Also included in the apparatus of the invention are sharpening rods 3. These rods are of circular cross-section and are elongated rods which are fabricated of an abrasive material such as, for example, aluminum oxide ceramic or the like. Silicon carbide and various natural stones may also be employed and it is also possible to employ steel rods coated with diamond dust or the like. As many rods as desired can be employed in accordance with the invention depending on the width of the base 1. As mentioned hereinabove, the lengths of the rods can be selected as long as they are accommodated within the bases of the clamps 2 which are loosened or tightened to enable fixing the rods 3 in desired position as will be explained hereinafter.

Also incorporated in the apparatus of the invention are the two further sharpening rods 4. These rods may be bonded to the base by an adhesive such as indicated at 4'. They may also be countersunk into the base as indicated by grooves 4''.

The invention furthermore includes for each clamp a tightening device or threaded bolt 5. These threaded bolts are provided with heads which are accommodated within recesses 11. Cooperatively associated with these threaded bolts are the washers 6. Also cooperating with the threaded bolts are wing nuts 7. Any similar type of nut may be employed and wing nuts are illustrated by way of example only.

In addition to the aforegoing elements, there is provided a resilient member in the form of a thin rubber or plastic foam material bonded to the base 1. This resilient member takes up any surface tolerance between the base and sharpening rods and also takes up any warp which may have occurred in the rods or in the base. The resilient member also protects the rods from cracking when clamped down. However, the most important function played by the resilient member is to allow the sharpening rods to be pressed into the same by the use of the clamps and tightening members referred to hereinabove whereby the rods may be first in loose and displaceable posture on top of the resilient member 8 and may then be brought to a fixed position by application of the clamps 2 operating in conjunction with the tightening members which have been described. As will be noted, the clamps may move longitudinally due to the provision of the elongated slots 12 which have lengths which exceed the diameter of the threaded bolts whereby relative movement therebetween is permissible and whereby the clamps 2 may accommodate sharpening rods of different lengths.

A thin rubber sheet 9 may be bonded to the bottom of the base if the unit is not otherwise bolted or clamped to a work surface. For this optional purpose, the base 1 is provided with mounting holes 10 which enable nailing or screwing the base 1 to the work surface.

FIG. 5 shows a knife K provided with a handle H and a blade B having a cutting edge C having serrations or indentations S formed therein. The indentations form points P therebetween. The serrations are generally of equal size and shape and points P are positioned between the serrations and are generally equi-distantly spaced along the cutting edge C. Rods 3 of different diameters can be used to match the diameters of the serrations. They may also be used in such a manner as to match the exact pitch of the wave edge of different knives. Rods of different degrees of cutting power may also be employed for different conditions of the knife edge. Different degrees of abrasiveness may be employed as desired and multitudes of sets of rods may be used in the apparatus which has been discussed hereinabove.

To enable the use of the apparatus with any given knife, the clamps 2 are set to loosened condition by unscrewing the wing nuts 7 to a partial degree. The knife blade B is laid transversely across the rods 3 and the points P are forced into the crevices or spaces between the rods. Each rod will fall into an indentation or serration S and accordingly be appropriately positioned for purposes of sharpening. The blade may be jiggled back and forth to assist in aligning the rods to fit into the serrations. When the rods are appropriately lined up, the wing nuts 7 are tightened on the threaded bolts 5 to force the clamps 2 against the ends of the rods 3, thereby to fix the rods in place. This may be practiced at both ends of the rods near the respective clamps for the best results. Thereafter, the blade is rubbed or wiped back and forth along the rods in longitudinal direction so that the respective serrations or indentations S are sharpened. The blade can be displaced transversely across the rods to bring different series or groups of the serrations into co-acting relationship with the rods which have been locked in position.

Figure 7:
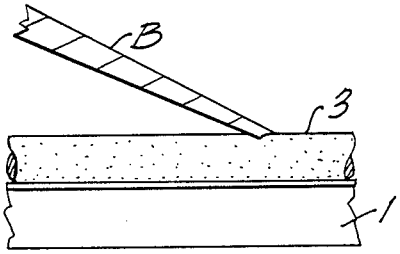
FIGS. 6, 7 and 8 illustrate the use of the sharpener of FIGS. 1–5.
Figure 6:
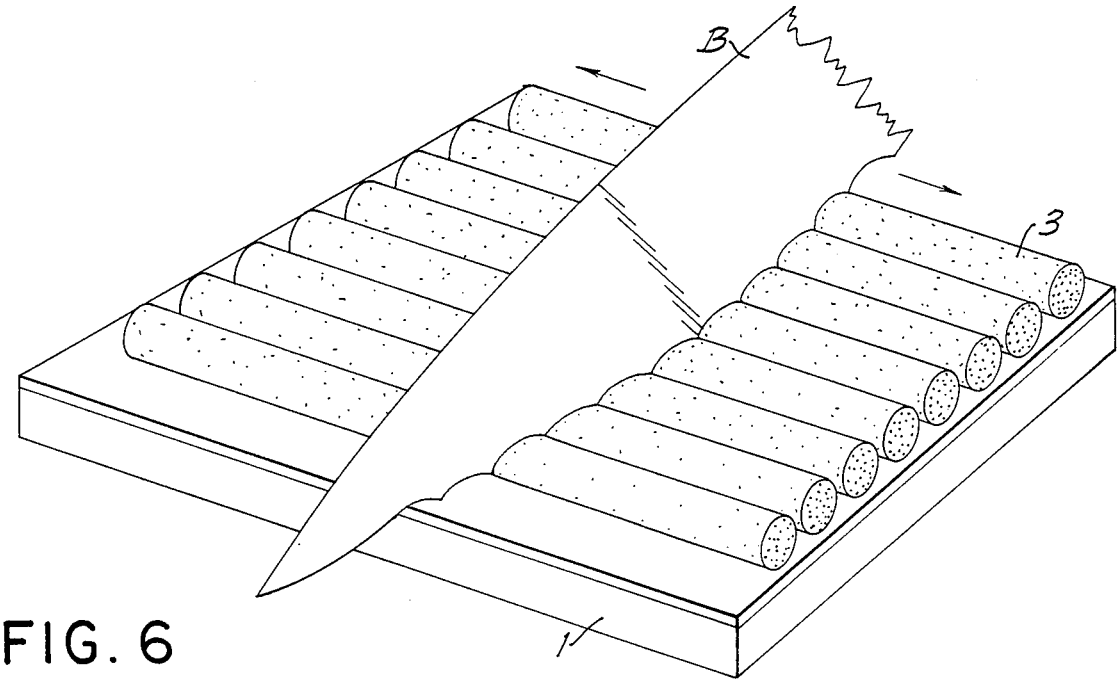

The blade will preferably be wiped along the rods at an inclined posture of approximately 30° to the horizontal (FIG. 6 and 7). This angle is not limiting of the invention.

Figure 8:
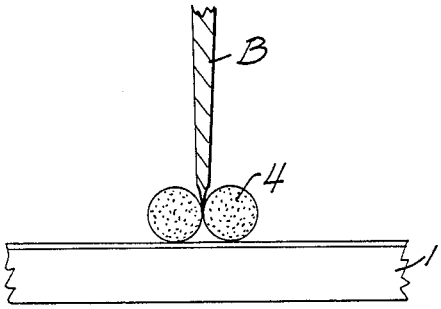

When the serrations have been appropriately sharpened, there remains the task of sharpening the points P between the serrations. This is accomplished by tracking the points (FIG. 8) in the groove or crevice between the sharpening rods 4. In this arrangement, the blade B is parallel to the rods 4 and aligned with the groove between these rods. The knife is then tracked back and forth along the groove between the rods to effect a sharpening of the points. It will be noted that the rods 4 are generally orthogonally arranged relative to the rods 3 and that there is no obstructive arrangement of parts at the ends of the rods 4. This enables the sharpening of the points to be effected in a single tracking operation with each of the points being moved downwardly along the lengths of the rods 4, but between the same.

From what has been stated hereinabove, it will appear that the invention provides a method which comprises loosely supporting a plurality of rods of abrasive material, applying a cutting edge having indentations therein transversely across the rods with the points between the indentations being positioned at least in part between the rods whereby the rods are forced into spaced relationship and into a posture which corresponds with the indentations on the cutting edge to be sharpened. The rods are locked into the thusly selected positions and the edge is wiped along the rods with the rods being positioned in the indentations.

There will now be obvious to those skilled in the art many modifications and variations of the method and structure set forth hereinabove. These modifications and variations will not depart from the scope of the invention if defined by the following claims.

What is claimed is:

1. Apparatus for sharpening a cutting edge having a plurality of indentations therein, said apparatus comprising a plurality of loose elongated sharpening means responsive to the application of said cutting edge to align with said indentations, locking means for locking the thusly aligned sharpening means in position so that the cutting edge can be wiped along the same to sharpen the cutting edge within the indentations and resilient means to support said sharpening means, said locking means urging the sharpening means in part into the resilient means.

2. Apparatus as claimed in claim 1 comprising a support means for supporting the resilient means with the sharpening means thereon, said support means further supporting the locking means for clamping the sharpening means against the resilient means.

3. Apparatus as claimed in claim 4 wherein the sharpening means are parallel rods of abrasive material.

4. Apparatus as claimed in claim 3 wherein the locking means are clamping members positioned to engage the ends of said rods, at least one of said clamping members being adjustable to enable the clamping of rods of different lengths.

5. Apparatus as claimed in claim 4 wherein the clamping members include flanges overlying end portions of the rods and tightening means for pressing the flanges against the rods.

6. Apparatus as claimed in claim 5 wherein the tightening means include interengaged threaded bolt and nut members and wherein at least one of the clamping members is provided with an elongated slot to receive the associated threaded bolt.

7. Apparatus as claimed in claim 4 wherein the cutting edge includes points between the indentations, said apparatus further comprising additional sharpening means defining a receptacle therebetween for receiving the points for sharpening the same.

8. Apparatus as claimed in claim 7 wherein said additional sharpening means are additional parallel rods of abrasive material fastened to said support means.

9. Apparatus as claimed in claim 8 wherein the additional parallel rods are positioned in at least substantially orthogonal relation to the first said rods.

10. Apparatus as claimed in claim 9 wherein said rods are of circular cross-section.

11. Apparatus for sharpening a serrated cutting edge having a plurality of indentations therein, said apparatus comprising a plurality of rods of abrasive material in parallel relation, adjusting means to adjust the spacing of rods to correspond to the positions of the indentations and resilient means against which to press said rods, said adjusting means allowing movement of said rods for adjustment purposes and for pressing the rods into the resilient means to lock the thusly positioned rods into position.

12. Apparatus as claimed in claim 11 wherein said cutting edge includes points between the indentations, said apparatus further comprising supplemental sharpening means for said points.

13. Apparatus as claimed in claim 11 wherein said rods are of circular cross-section with substantially the same diameter.

14. Apparatus as claimed in claim 13 wherein said supplemental sharpening means includes juxtaposed abrasive rods, said apparatus comprising means for supporting the first said rods by endwise engagement of the same and means for supporting the rods of the supplemental sharpening means by peripheral engagement of the same.

15. Apparatus for sharpening a cutting edge having a plurality of indentations with points therebetween, said apparatus comprising a plurality of loose elongated sharpening means responsive to the application of said cutting edge to align with said indentations, locking means for locking the thusly aligned sharpening means in position so that the cutting edge can be wiped along the same to sharpen the cutting edge within the indentations and additional sharpening means defining a receptacle therebetween for receiving the points for sharpening the same.

16. A method of sharpening a serrated cutting edge having spaced points separated by indentations, said method comprising loosely supporting a plurality of rods of abrasive material, applying the cutting edge transversely across the rods with the points at least in part between the rods so that the rods move into positions whereat the rods are spaced in correspondence with the indentations, locking the rods in said positions by clamping the rods against a resilient pad, and wiping the edge along the rods with the rods positioned in the indentations.

17. A method as claimed in claim 16 comprising supporting two further abrasive rods in parallel relation and tracking said points between the further abrasive rods to sharpen the points.

18. A method of sharpening a serrated cutting edge having spaced points separated by indentations, said method comprising loosely supporting a plurality of rods of abrasive material, applying the cutting edge transversely across the rods with the points at least in part between the rods so that the rods move into positions whereat the rods are spaced in correspondence with the indentations, locking the rods in said positions, wiping the edge along the rods with the rods positioned in the indentations, supporting two further abrasive rods in parallel relation and tracking said points between the further abrasive rods to sharpen the points.

* * * * *